US011660484B2

(12) United States Patent
Melgosa Arcos

(10) Patent No.: US 11,660,484 B2
(45) Date of Patent: May 30, 2023

(54) SAFETY MONITORING DEVICE FOR FIRE EXTINGUISHING SYSTEMS

(71) Applicant: RG Green Systems, S.L., Burgos (ES)

(72) Inventor: Raul Melgosa Arcos, Burgos (ES)

(73) Assignee: RG GREEN SYSTEMS, S.L, Burgos (ES)

( * ) Notice: Subject to any disclaimer, the term of this patent is extended or adjusted under 35 U.S.C. 154(b) by 397 days.

(21) Appl. No.: 16/496,096

(22) PCT Filed: Feb. 1, 2018

(86) PCT No.: PCT/ES2018/070078
§ 371 (c)(1),
(2) Date: Sep. 20, 2019

(87) PCT Pub. No.: WO2018/172576
PCT Pub. Date: Sep. 27, 2018

(65) Prior Publication Data

US 2021/0106859 A1 Apr. 15, 2021

(30) Foreign Application Priority Data

Mar. 21, 2017 (ES) ..... 201730309U

(51) Int. Cl.
*A62C 37/50* (2006.01)
*A62C 35/02* (2006.01)
(Continued)

(52) U.S. Cl.
CPC ..... *A62C 37/50* (2013.01); *A62C 13/76* (2013.01); *A62C 35/02* (2013.01); *A62C 35/68* (2013.01)

(58) Field of Classification Search
CPC ..... A62C 35/02; A62C 35/68; A62C 37/50; A62C 13/76
(Continued)

(56) References Cited

U.S. PATENT DOCUMENTS 4,304,424 A * 12/1981 Hansen ..... F16L 25/08 285/111
4,700,027 A * 10/1987 Tischhauser ..... H01H 13/06 200/302.2
(Continued)

FOREIGN PATENT DOCUMENTS

CN 203507360 U 4/2011
CN 203577197 U 5/2014
(Continued)

OTHER PUBLICATIONS

Int'l. Search Report for PCT/ES2018/070078, dated May 28, 2018.

*Primary Examiner* — Jason J Boeckmann
(74) *Attorney, Agent, or Firm* — MaxGoLaw PLLC

(57) ABSTRACT

A safety monitoring device is provided for fire extinguishing systems that includes a main body couplable to any type of head of fire extinguishing systems. The safety monitoring device is screwed on between the discharge valve or device, that incorporates the fluid outlet as well as electric, pneumatic, hydraulic, or manual activation and the thread of the valve. The safety monitoring device further includes a sensor connected to an electronic board and through it, to a control room, programmable automaton, or other control means of the extinguishing system, that detects whether the head is correctly screwed on and that, if it is not, sends a signal, through the electronic board to the control room of the installation. Preferably, the sensor is a push-button termination that protrudes at the lower part of the main body and when fully screwing on the device it contacts the surface of the valve.

14 Claims, 2 Drawing Sheets

(51) Int. Cl.
*A62C 13/76* (2006.01)
*A62C 35/68* (2006.01)

(58) Field of Classification Search
USPC ..... 285/93
See application file for complete search history.

(56) References Cited

U.S. PATENT DOCUMENTS

| | | | | |
|---|---|---|---|---|
| 9,714,718 | B2 * | 7/2017 | Rogala | A62C 37/50 |
| 2004/0194980 | A1 | 10/2004 | McSheffrey et al. | |
| 2016/0356395 | A1 * | 12/2016 | Rogala | F16K 27/029 |
| 2018/0133529 | A1 * | 5/2018 | Kjellman | A62C 37/50 |

FOREIGN PATENT DOCUMENTS

| | | | |
|---|---|---|---|
| ES | 2155318 | A1 | 5/2001 |
| ES | 1057712 | U | 9/2004 |
| ES | 1141666 | U | 7/2015 |
| ES | 1143033 | U | 8/2015 |

* cited by examiner

SAFETY MONITORING DEVICE FOR FIRE EXTINGUISHING SYSTEMS

OBJECT OF THE INVENTION

The object of the invention herein is a safety monitoring device for fire extinguishing systems.

The inventive safety monitoring device includes a housing that houses an electronic board connected to a power line, the housing adapted to be installed in the heads of fire extinguishing systems. The fire extinguishing systems include those having bottles or reservoirs of gas, powder, water, foam, etc., that are operated by the activation of discharge valves or devices. Embodiments of the inventive safety monitoring device continuously monitor whether the electric, pneumatic, hydraulic, or manual heads of the fire extinguishing systems are perfectly screwed, and provide a warning when they are not, to a control room, programmable automaton, or other control means that the fire extinguishing system has an improperly installed head.

FIELD OF APPLICATION OF THE INVENTION

The field of application of this invention is within the sector of the industry engaged in manufacturing safety and control apparatuses and devices particularly focused in the field of fire extinguishing systems.

BACKGROUND OF THE INVENTION

While there are fire extinguishing systems that are equipped with a safety device that activates an alarm or warning in case of anomalies in the installation of heads in the system, however in most instances these devices indicate whether the head is installed or not, but do not detect the heads perfect installation, that means, the device would give a signal of correct position in the control room even though the head is simply located at an intended location but has not been properly screwed on to the fire extinguishing system, with the damaging consequences it would carry.

Therefore there is a need to provide a novel safety device that, in addition to the ability to detect whether the head is installed on the discharge valve of the fire extinguishing systems with bottles, cylinders, or reservoirs of fluids for extinguishing fires, but also to control the correct location of the head on the discharge valve of the bottle, cylinder, or reservoir, making sure that the head has been fully screwed on, and therefore it is properly installed for its correct operation.

SUMMARY OF THE INVENTION

Embodiments of the invention provide an electronic safety monitoring device applicable to the heads of fire extinguishing systems, of gas, powder, water, foam, etc. The function of the heads is to activate discharge valves or devices of the fire extinguishing system. The aim of the safety monitoring device is to continuously monitor that the heads are perfectly installed and, if they are not, warn the control room, programmable automaton, or other control means of the fire extinguishing system.

For this, the safety monitoring device includes an electronic board connected to a power line, a sensor, and a tiny push-button termination of end of line, incorporated in a housing adapted to be installed in every type of head of existing fire extinguishing systems, of gas, powder, water, foam, etc., which are essential for activating discharge valves or devices of the extinguishing, controlling and suppressing fire systems. The safety monitoring device continuously monitors whether the heads that can be electric, pneumatic, hydraulic, manuals, etc., are perfectly screwed, because if they are not, the safety monitoring device at the end of line warns the control system that the heads are improperly installed.

Thus, it is avoided that, if the operators have made some error when installing the head device, or if during maintenance tasks the activation was left on, the possible consequences that a real discharge of the system occurs, or on the contrary if the head is left dismounted, that the system is not activated in the event that an actual fire occurs More specifically, the safety monitoring device of the invention possesses an internal nut that is perfectly coupled to the support of the heads, between the discharge valve and the activating head, as well as an external housing in which the wiring that connects the tiny push-button termination is located.

In addition, the housing is rotary, so that it is capable of rotating about the internal nut to be able to place the safety monitoring device in the best fit position or in that which is most convenient for each installation.

The rotary housing has a tightening bolt to be able to tightly screw the internal nut that, once correctly screwed on, the bolt is removed, the housing is placed in the position sought and the housing is fastened with a locking set screw in order that it remains fastened in the final position.

As for the electric components, they comprise a push-button termination or end of line that can be NA (open) or NC (closed), a printed board and a power strip from which four cables start, two that connect with the control room or system of the fire extinguishing installation for its supervision, and two others connecting with an end of line and this way complete the supervision circuit or to connect in series or parallel the following safety monitoring device incorporated in another or successive bottles, cylinders or reservoirs of the extinguishing system.

The safety monitoring device of the invention possesses a high precision and sensitivity detection, because it is capable of detecting that a device is improperly screwed on with less than a screw thread missing, despite the fact the head device in fact would theoretically activate the extinguishing system, the safety monitoring device still gives the signal of the heads improper installation for safety purpose, because if the heads are not perfectly placed, improper operation of the system can be caused, and therefore the equipment would not be correctly activated.

It is important to point out this feature, because, as it was commented in the above paragraphs, most existing control devices simply control whether the head is installed or not, but they do not detect its correct installation, that means that they give a signal of correct position in the control room even though the device is simply located at its place without in fact being screwed, with the consequences this would carry.

Furthermore, it may occur that the head is incorrectly screwed on due to a given orientation because of requirements of the installation, the device of this invention advantageously provides that this does not occur, as it was explained, it can rotate about itself to be placed in the position sought, whereby there is no problem for perfectly installing it until it reaches its stop, it suffices to remove the locking elements and rotate them towards the best fitted orientation.

DESCRIPTION OF THE DRAWINGS

To complement the description provided and in order to assist to best understand the characteristics of the invention, attached to this specification, as an integral part thereof, there is a set of drawings in which with illustrative and non-limitative purpose the following has been represented.

PREFERRED EMBODIMENT OF THE INVENTION

Figure 1:
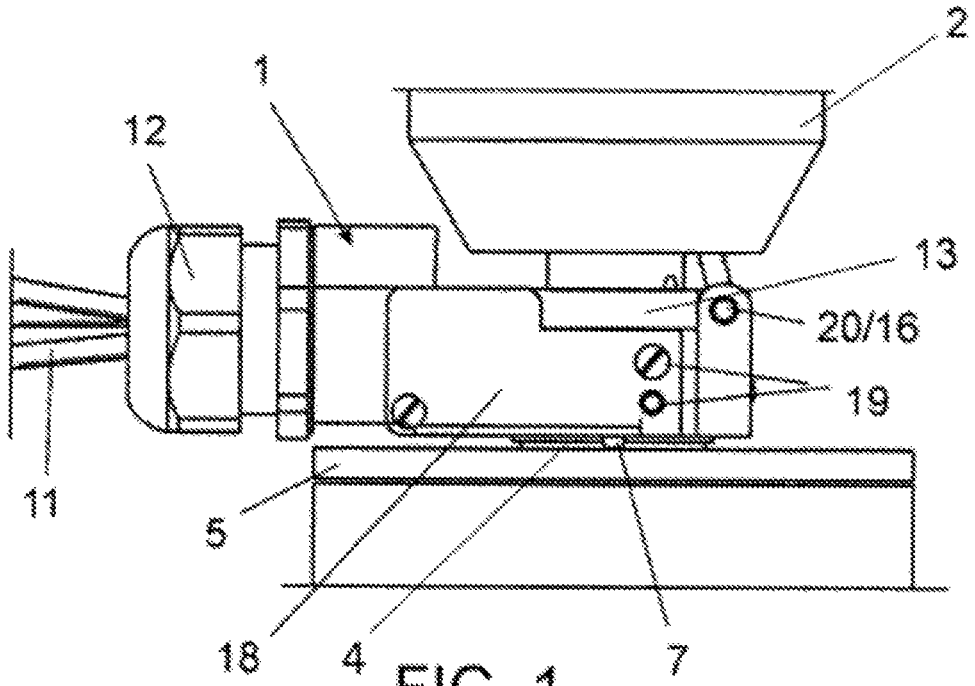
FIG. 1 shows an elevation view of an example of the safety monitoring device for fire extinguishing systems, which has been represented in a position of use, after it was incorporated to the bottle or reservoir of the extinguishing system, between the thread of the valve and the activating head.
Figure 2:
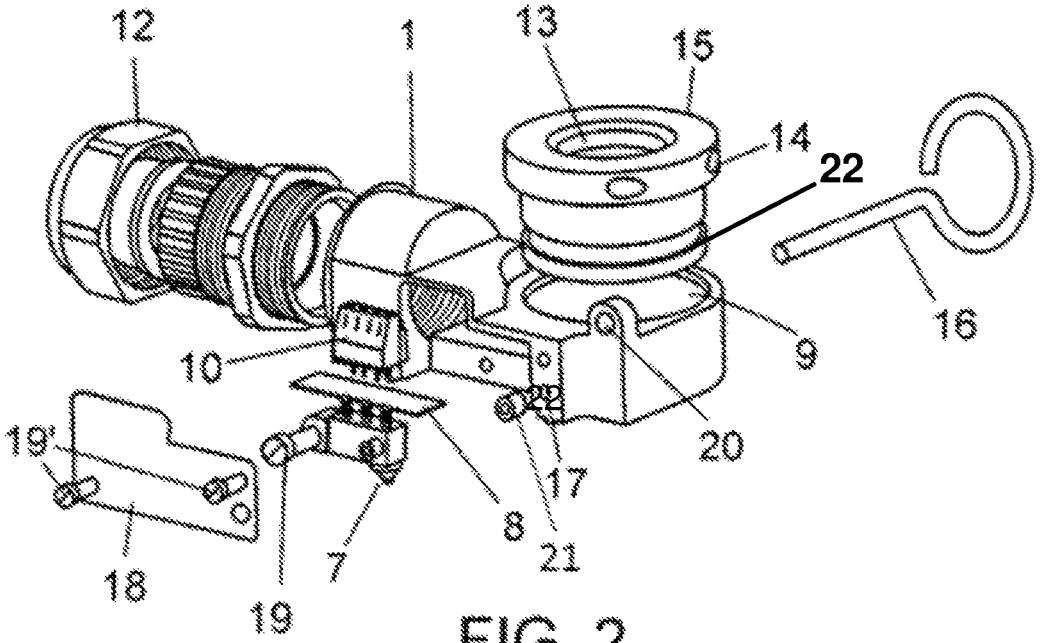
FIG. 2 shows an exploded perspective view of the safety monitoring device for fire extinguishing systems, according to the invention.

At the sight of the mentioned figures, and according to the numerals adopted in them, a non-limitative example of the safety monitoring device for fire extinguishing systems of the invention can be seen, that comprises the parts and elements that are stated and disclosed in detail thereafter.

Thus, as it can be seen in the said figures, the device of the invention comprises a main body (1) couplable to any type of activation heads (2), that can be of electric, pneumatic, hydraulic or manual activation, of fire extinguishing systems, for example bottles (3) cylinders or reservoirs, of gas, powder, water, foam, etc., screwed between the discharge valve (5) or device, and that generally incorporates the fluid outlet (6), which possesses a sensor (7), connected to an electronic board (8) and, through it, to a control room, programmable automaton, or other control means (23) of the extinguishing system, that detects whether the head (2) is correctly screwed in the valve (5) or fire extinguishing system. If the activation head (2) is not perfectly screwed on the safety monitoring device sends a signal to the control room (23) of the installation.

Preferably, the sensor (7) is a push-button termination or of end of line, NA (open) or NC (closed), that is arranged behind a protecting cover (18), so that it protrudes at the lower part of the main body (1), thus, when fully screwing the activation device (2) with the valve (5) the sensor (7) is activated with the surface of the valve (5) and shuts the safety circuit.

The sensor (7) is housed behind the protecting cover (18), together with the electronic board (8) and a power strip (10) from which a wiring (11) starts, that through a gland (12) connects with the control room (23), and optionally in series or parallel with other cylinders (3') or extinguishing systems of the same or different installation.

Figure 3:
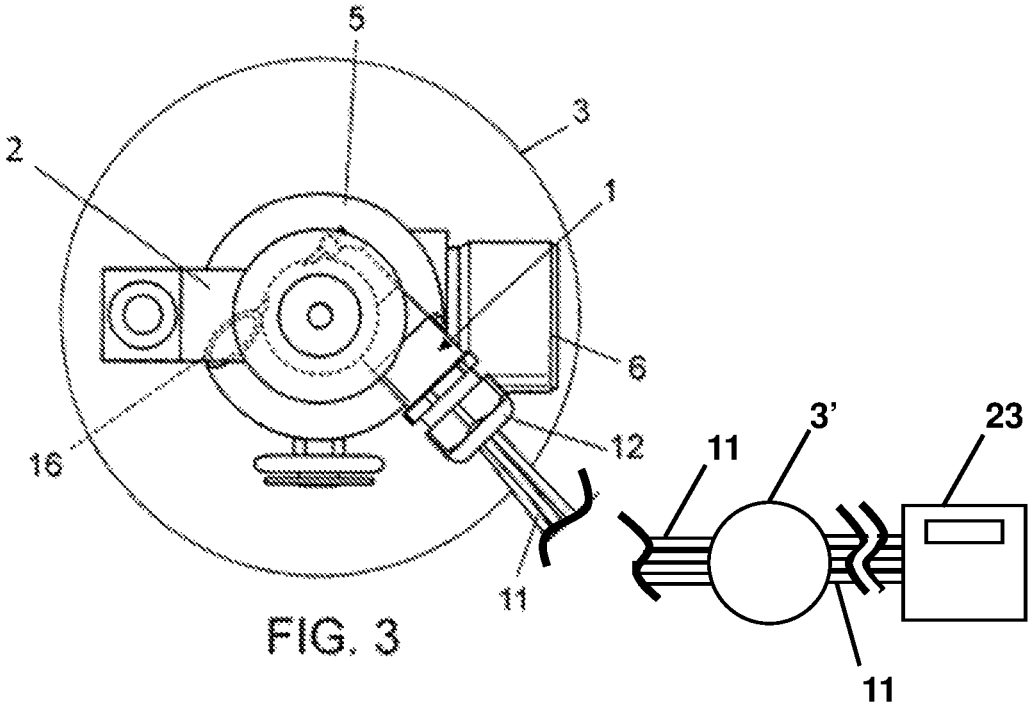
FIGS. 3 and 4 show the device in respective top views of two possible positions of location among the number in which it can be placed.
Figure 4:
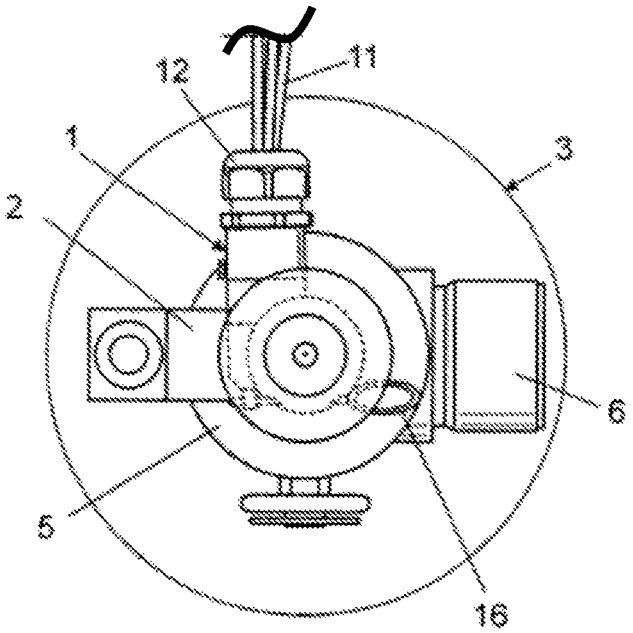

It is important to point out that, for coupling the main body (1) to the valve (5), of the bottle (3), reservoir or extinguishing system, an internal nut (13) has been provided with thread (22) for its installation in the valve (5) that is installed in a housing (9) of the body of the main body (1) and allows it to freely rotate, in order to be able to locate it in any position and chose the one that best fits in each case, as is shown in the FIGS. 3 and 4.

For screwing and locking the main body (1) the internal nut (13), possesses a through transversal hole (14) and an upper thickening (15), adapted to insert a tightening bolt (16) that, provided with a head to facilitate its handling, allows to apply the strength necessary for the said fastening. In addition, the main body (1) possesses a lug (20) in which the end of the bolt (16) is inserted for locking. To fasten the main body (1), after the position sought has been chosen, it possesses a side thread (17) adapted for inserting a locking screw (21) that, when it crosses the housing wall (9) is interlocked, securely, in the internal nut (13).

Last, it shall be mentioned that the protecting cover (18) that covers the sensor (7), push-button termination of end of line, electronic board (8) and power strip (10) is laterally fastened on the body of the main body (1), by means of its respective tightening screw (19), allowing its easy dismounting to have access to the covered components and allow for the repair or replacement of components in case of deterioration, failure, or bad contact.

The nature of this invention being sufficiently disclosed, as well as the way of implementing it, it is not deemed necessary to extend any longer its explanation in order that a person skilled in the art understands its extent and the advantages arising from it, and it is stated that, within its essence, it can be implemented in other embodiments that differ in detail from the one stated for example purpose, and to which also extends the protection applied for, provided that its fundamental principle is not altered, changed or modified.

The invention claimed is:

1. A safety monitoring device for fire extinguishing systems, wherein the safety monitoring device comprises a main body (1) having a bottommost surface and couplable to an activation head (2) of the fire extinguishing systems that has a fluid outlet (6), of electric, pneumatic, hydraulic, or manual activation and a thread (4) of a discharge valve (5), the safety monitoring device possessing a sensor (7) protruding as a button contact below the bottommost surface of the main body (1) connected to an electronic board (8) and, through the electronic board (8), to a control room, programmable automaton or other control means (23) of the fire extinguishing systems;

wherein the sensor (7) and electronic board (8) are mounted to an external surface of the main body (1); and wherein the main body (1) comprises a housing (9) with a circular opening such that when the safety monitoring device is coupled through the housing (9) to a specific activation head (2), and the specific activation head (2) is screwed to the discharge valve (5), the sensor (7) directly contacts a surface of the discharge valve (5) to detect whether the specific activation head (2) is correctly screwed on and that, if the sensor (7) screwed to the discharge valve (5) of the specific activation head (2) is not contacting the surface of the discharge valve (5), the sensor (7) sends a signal, through the electronic board (8), to at least one of the control room, the programmable automaton or the other control means (23) of an installation.

2. The safety monitoring device according to the claim 1, wherein the sensor (7) comprises a push-button that protrudes at the bottommost surface of the main body (1), so that, when the head (2) is fully screwed to the surface of the discharge valve (5) the push-button contacts the surface of discharge valve (5).

3. The safety monitoring device according to the claim 1, wherein the sensor (7) is housed behind a protecting cover (18) laterally fastened on the main body (1) by screws (19), together with the electronic board (8) and a power strip (10) from which a set of wires (11) routed through a gland (12), connect the sensor (7) with at least one of the control room (23), the programmable automaton or the other control means (23) of the installation.

4. The safety monitoring device according to the claim 3, wherein the wiring (11) connects in series with one or more additional safety monitoring devices individually mounted to one or more additional activation heads (2) of a set of other bottles (3') of the fire extinguishing system.

5. The safety monitoring device according to claim 2, wherein for coupling the main body (1) to the discharge valve (5) of a bottle (3) or a reservoir of the fire extinguishing system, an internal nut (13) with a thread (22) has been provided for installation in the discharge valve (5).

6. The safety monitoring device according to the claim 5, wherein the internal nut (13) is coupled in an axis of the housing (9), so that the main body (1) freely rotates about the bottle (3), to be able to place the main body (1) in any rotational position with respect to the bottle (3).

7. The safety monitoring device according to the claim 5, wherein the internal nut (13) has a through trough transversal hole (14) in an upper thickening rim (15) adapted to insert a tightening and locking bolt (16), and the main body (1) has a lug (20) in which a distal end of the tightening and locking bolt (16) is inserted following insertion of the tightening and locking bolt (16) through the transversal hole (14).

8. The safety monitoring device according to claim 2, wherein the main body (1) has a thread (17) adapted for inserting a locking screw (21) that crosses a wall of the housing (9) and is interlocked in an internal nut (13).

9. The safety monitoring device of claim 1 wherein the fire extinguishing system comprises a bottle (3) cylinder, a bottle reservoir, a gas cylinder, a powder cylinder, a water cylinder, or a foam cylinder.

10. The safety monitoring device according to claim 3, wherein for coupling the main body (1) to the discharge valve (5) of a bottle (3) or a reservoir of the fire extinguishing system, an internal nut (13) with a thread (22) has been provided for installation in the discharge valve (5).

11. The safety monitoring device according to claim 4, wherein for coupling the main body (1) to the discharge valve (5) of a bottle (3) or a reservoir of the fire extinguishing system, an internal nut (13) with a thread (22) has been provided for installation in the discharge valve (5).

12. The safety monitoring device according to the claim 6, wherein the internal nut (13) has a through transversal hole (14) in an upper thickening rim (15) adapted to insert a tightening and locking bolt (16), and the main body (1) has a lug (20) in which a distal end of the tightening and locking bolt (16) is inserted following insertion of the tightening and locking bolt (16) through the transversal hole (14).

13. The safety monitoring device according to claim 5, wherein the main body (1) has a thread (17) adapted for inserting a locking screw (21) that crosses a wall of the housing (9) and is interlocked in the internal nut (13).

14. The safety monitoring device according to claim 6, wherein the main body (1) has a thread (17) adapted for inserting a locking screw (21) that crosses a wall of the housing (9) and is interlocked in the internal nut (13).

* * * * *